US010084270B2

(12) United States Patent
Tsai et al.

(10) Patent No.: US 10,084,270 B2
(45) Date of Patent: Sep. 25, 2018

(54) ELECTRICAL RECEPTACLE CONNECTOR

(71) Applicant: ADVANCED-CONNECTEK INC., New Taipei (TW)

(72) Inventors: Yu-Lun Tsai, New Taipei (TW); Pin-Yuan Hou, New Taipei (TW); Chung-Fu Liao, New Taipei (TW); Long-Fei Chen, New Taipei (TW); Dong Xiang, New Taipei (TW)

(73) Assignee: ADVANCED-CONNECTEK INC., New Taipei (TW)

( * ) Notice: Subject to any disclaimer, the term of this patent is extended or adjusted under 35 U.S.C. 154(b) by 0 days.

(21) Appl. No.: 15/272,813

(22) Filed: Sep. 22, 2016

(65) Prior Publication Data

US 2017/0085036 A1 Mar. 23, 2017

(30) Foreign Application Priority Data

Sep. 23, 2015 (CN) ..... 2015 1 0609967

(51) Int. Cl.

| | |
|---|---|
| ***H01R 13/658*** | (2011.01) |
| ***H01R 24/60*** | (2011.01) |
| ***H01R 13/6585*** | (2011.01) |
| *H01R 107/00* | (2006.01) |

(52) U.S. Cl.

CPC ..... *H01R 24/60* (2013.01); *H01R 13/6585* (2013.01); *H01R 2107/00* (2013.01)

(58) Field of Classification Search

CPC ..... H01R 13/648; H01R 13/6581; H01R 13/6582; H01R 23/02

USPC ..... 439/607.01, 607.05, 607.53, 607.55, 660

See application file for complete search history.

(56) References Cited

U.S. PATENT DOCUMENTS 4,696,530 A * 9/1987 Vandame ..... H01R 13/113 439/266
5,147,230 A * 9/1992 Plyler ..... H01R 13/187 439/843
5,427,553 A * 6/1995 Tsuji ..... H01R 13/187 439/842

(Continued)

FOREIGN PATENT DOCUMENTS

CN 204243262 U * 4/2015 ..... H01R 13/6585

*Primary Examiner* — Hae Moon Hyeon
*Assistant Examiner* — Thang Nguyen
(74) *Attorney, Agent, or Firm* — Muncy, Geissler, Olds & Lowe, P.C.

(57) ABSTRACT

An electrical receptacle connector includes a metallic shell and one or more insertion modules. The metallic shell includes two first walls, two second walls, and several protrusions. The walls form an insertion space. The protrusions are extending toward the insertion space from the first walls, and the protrusions are integrally formed on the first walls seamlessly. The insertion module includes an insulated housing, first receptacle terminals, second receptacle terminals, and a grounding plate between the first receptacle terminals and the second receptacle terminals. When the electrical receptacle connector is mated with an electrical plug connector, the protrusions are in contact with a metallic shell of the electrical plug connector. Because the walls of the metallic shell are seamless, the connector assembly of the plug and receptacle can be waterproof. Moreover, the contacts between the protrusions and the electrical plug connector reduce the electromagnetic interferences and the radiofrequency interferences.

12 Claims, 7 Drawing Sheets

(56) References Cited

U.S. PATENT DOCUMENTS

| | | | | |
|---|---|---|---|---|
| 5,658,174 | A * | 8/1997 | Benes | H01R 13/187 439/842 |
| 2014/0024263 | A1* | 1/2014 | Dong | H01R 13/516 439/660 |
| 2015/0318646 | A1* | 11/2015 | Little | H01R 4/023 439/78 |
| 2016/0020549 | A1* | 1/2016 | Chen | H01R 13/5219 439/78 |
| 2016/0064870 | A1* | 3/2016 | Yu | H01R 24/60 439/607.05 |
| 2016/0118750 | A1* | 4/2016 | Guo | H01R 13/6585 439/78 |
| 2016/0359274 | A1* | 12/2016 | Zhang | H01R 43/24 |
| 2016/0380388 | A1* | 12/2016 | Guo | H01R 24/60 439/83 |

* cited by examiner

ELECTRICAL RECEPTACLE CONNECTOR

CROSS-REFERENCE TO RELATED APPLICATION

This non-provisional application claims priority under 35 U.S.C. § 119(a) to Patent Application No. 201510609967.4 filed in China, P.R.C. on Sep. 23, 2015, the entire contents of which are hereby incorporated by reference.

FIELD OF THE INVENTION

The instant disclosure relates to an electrical connector, and more particular to a USB electrical receptacle connector.

BACKGROUND

Generally, Universal Serial Bus (USB) is a serial bus standard to the PC architecture with a focus on computer interface, consumer and productivity applications. The existing Universal Serial Bus (USB) interconnects have the attributes of plug-and-play and ease of use by end users. Now, as technology innovation marches forward, new kinds of devices, media formats and large inexpensive storage are converging. They require significantly more bus bandwidth to maintain the interactive experience that users have come to expect. In addition, the demand of a higher performance between the PC and the sophisticated peripheral is increasing. The transmission rate of USB 2.0 is insufficient when the USB interface is applied for high frequency, radiofrequency, wireless, or Bluetooth signals transmission.

As a result, USB 3.0 and USB 3.1 interfaces are gradually developed. However, the crosstalk and interference problems may become serious due to the higher transmission speed. Not only external electromagnetic interferences but also the crosstalk between terminals of the product will adversely affect the product performance.

In order to suppress the crosstalk interferences, the external electromagnetic interference, or the radiofrequency interferences, shielding members are provided. As a result, the connector would have too many components to be manufactured in an easy way. In addition, the connector would have many cracks for the insertions of the fixtures. Hence, the structural strength of the connector is reduced, and the defect-free rate of the product is reduced as well. Furthermore, some connectors may be utilized under water. Consequently, when these connectors with cracks are utilized under water, water may enter into the connector to damage the circuit board in the connector. As a result, once the connector is damaged, the whole receptacle has to be detached from the assembled circuit board and repaired separately. Therefore, the overall cost for repairing the connector assembly may be very expensive.

SUMMARY OF THE INVENTION

Therefore, how to provide a connector which is waterproof and has improved structural strength as well as shielding performance is an issue.

In view of this, an embodiment of the instant disclosure provides an electrical receptacle connector. The electrical receptacle connector comprises a metallic shell and at least one insertion module. The metallic shell comprises two first walls, two second walls, and a plurality of protrusions. The first walls are opposite to each other. The second walls are opposite to each other. Each of the second walls is connected to the first walls. The first walls and the second walls form an insertion space. The protrusions are extending toward the insertion space from the first walls, and the protrusions are integrally formed on the first walls seamlessly. The insertion module comprises an insulated housing, a plurality of first receptacle terminals, a plurality of second receptacle terminals, and a grounding plate. The first receptacle terminals, the second receptacle terminals, and the grounding plate are fixed in the insulated housing, and the grounding plate is between the first receptacle terminals and the second receptacle terminals. When the electrical receptacle connector is mated with an electrical plug connector, the protrusions are in contact with a metallic shell of the electrical plug connector.

In one embodiment, the metallic shell comprises a plurality of recesses on the first walls. The protrusions are on one of two opposite surfaces of each of the first walls, and the recesses are on the other surface of each of the first walls.

In one embodiment, the metallic shell is a one-piece member.

In one embodiment, the insulated housing comprises a base portion and a tongue portion extending from one end of the base portion. Each of the first receptacle terminals comprises a first flat contact portion, and each of the second receptacle terminals comprises a second flat contact portion. The first flat contact portions and the second flat contact portions are respectively on an upper surface and a lower surface of the tongue portion. In addition, the grounding plate is exposed from a lateral surface of the tongue portion. Moreover, each of the first receptacle terminals further comprises a first tail portion extending from the corresponding first flat contact portion, and each of the second receptacle terminals further comprises a second tail portion extending from the corresponding second flat contact portion. The first tail portions and the second tail portions are protruding from the base portion.

In one embodiment, the first receptacle terminals, the second receptacle terminals, and the grounding plate are fixed in the insulated housing by insert-molding techniques. In another embodiment, the first receptacle terminals, the second receptacle terminals, and the grounding plate are fixed in the insulated housing by assembling.

In one embodiment, the insertion module further comprises a first conductive sheet and a second conductive sheet. The first conductive sheet is on an upper portion of the insulated housing to partially shield the first receptacle terminals, and the second conductive sheet is on a lower portion of the insulated housing to partially shield the second receptacle terminals.

In one embodiment, the electrical receptacle connector further comprises a second metallic shell assembled to the metallic shell and enclosing the metallic shell.

In one embodiment, a pin assignment of the first receptacle terminals is left-right reversal with respect to a pin-assignment of the second receptacle terminals. accordingly, the electrical receptacle connector can have a 180 degree symmetrical, dual or double orientation design and pin assignments which enables the electrical receptacle connector to be mated with a corresponding plug connector in either of two intuitive orientations, i.e. in either upside-up or upside-down directions.

As above, the walls of the metallic shell are seamless. Therefore, after the electrical receptacle connector is mated with an electrical plug connector, the connector assembly of the plug and receptacle can be waterproof. Moreover, the protrusions of the metallic shell can be in contact with the metallic shell of the electrical plug connector, so that the electrical plug connector can be mated with the electrical receptacle connector firmly and closely to further improve the waterproof function, and the contacts between the protrusions and the metallic shell of the electrical plug connector can form a grounding circuit for reducing the electromagnetic as well as radiofrequency interferences during the operation. Accordingly, the connector can be utilized in high frequency, high transmission speed applications.

Detailed description of the characteristics and the advantages of the instant disclosure are shown in the following embodiments. The technical content and the implementation of the instant disclosure should be readily apparent to any person skilled in the art from the detailed description, and the purposes and the advantages of the instant disclosure should be readily understood by any person skilled in the art with reference to content, claims, and drawings in the instant disclosure.

BRIEF DESCRIPTION OF THE DRAWINGS

The instant disclosure will become more fully understood from the detailed description given herein below for illustration only, and thus not limitative of the instant disclosure, wherein.

DETAILED DESCRIPTION

Figure 1:
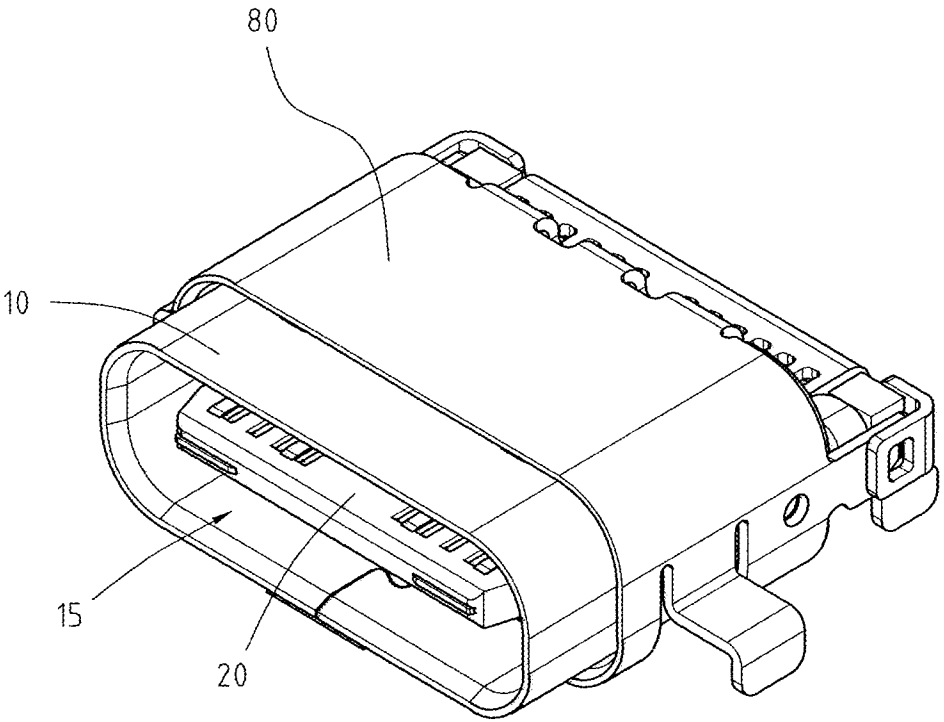
FIG. 1 illustrates a perspective view of an electrical receptacle connector according to an exemplary embodiment of the instant disclosure.
Figure 2:
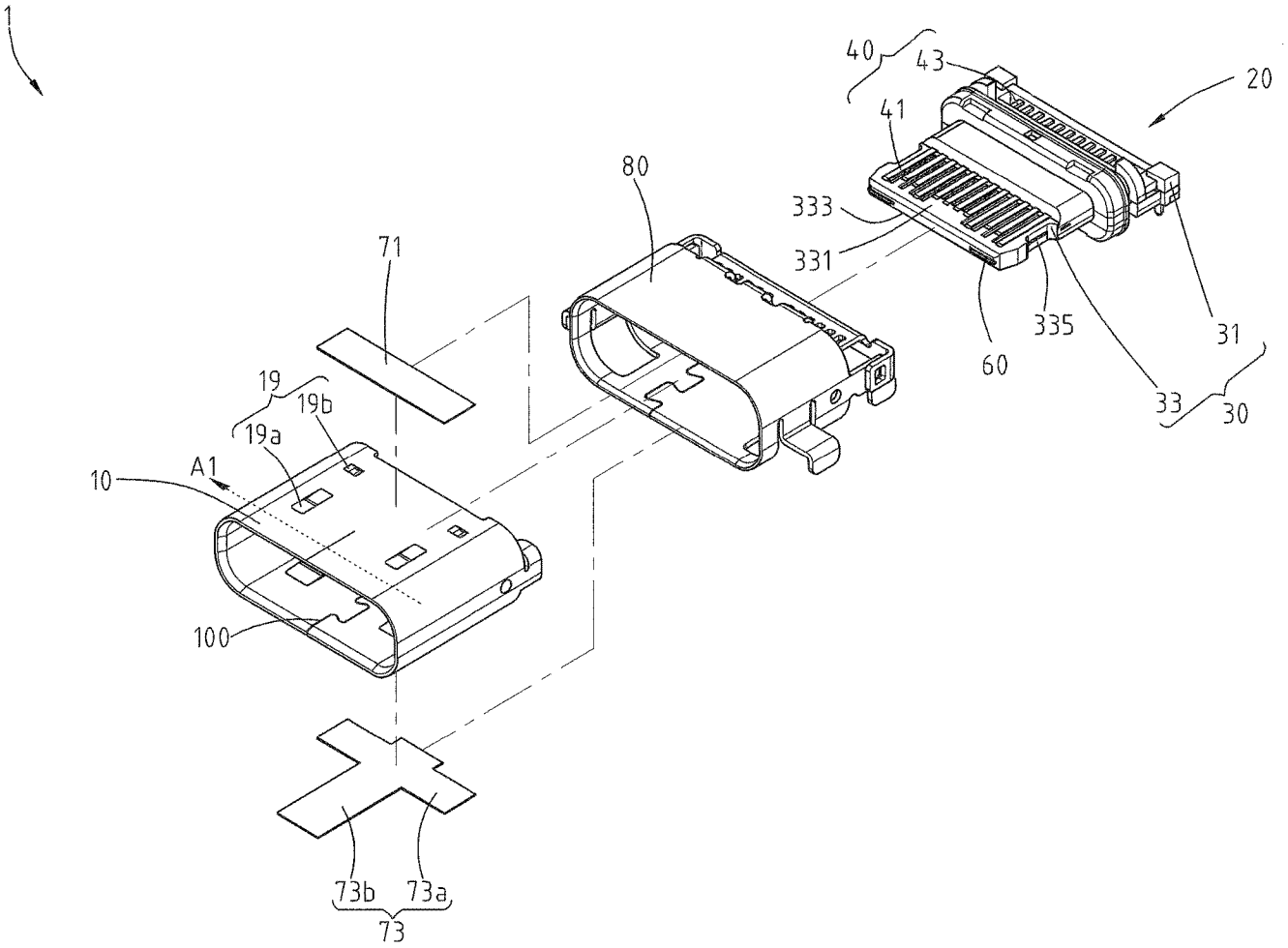
FIG. 2 illustrates an exploded view of the electrical receptacle connector.
Figure 3:
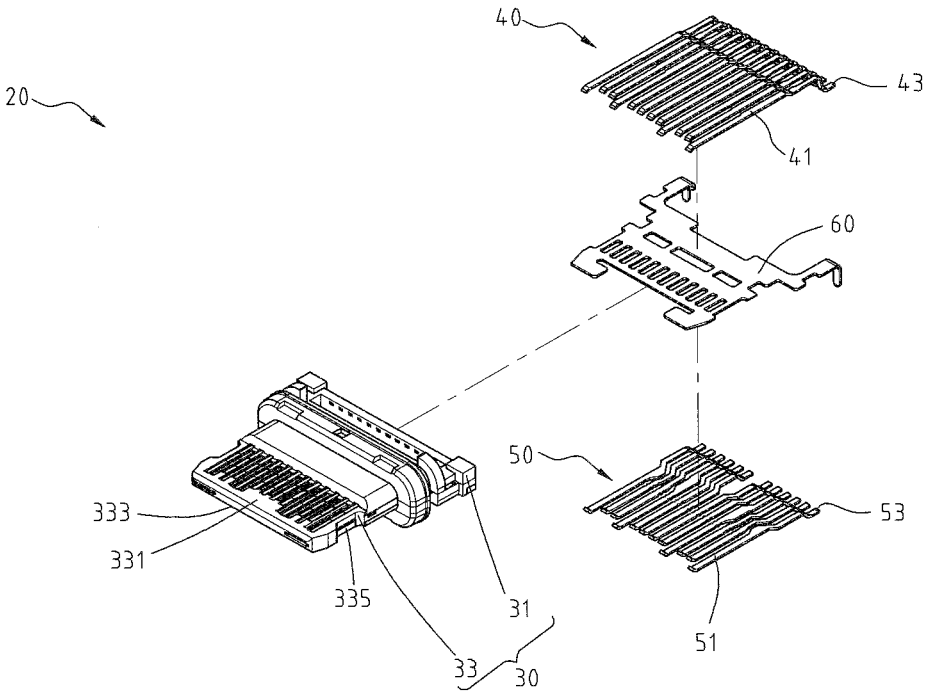
FIG. 3 illustrates an exploded view of an insertion module of the electrical receptacle connector.
Figure 4:
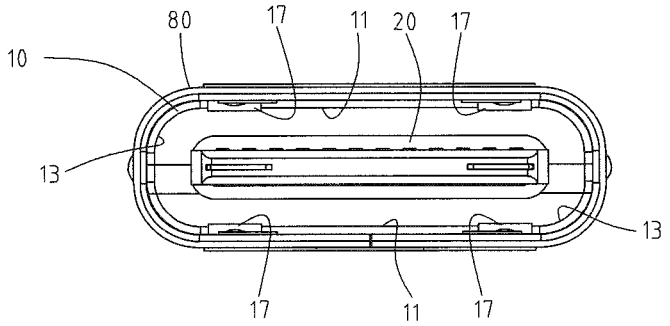
FIG. 4 illustrates a front view of a metallic shell of the electrical receptacle connector.
Figure 7:
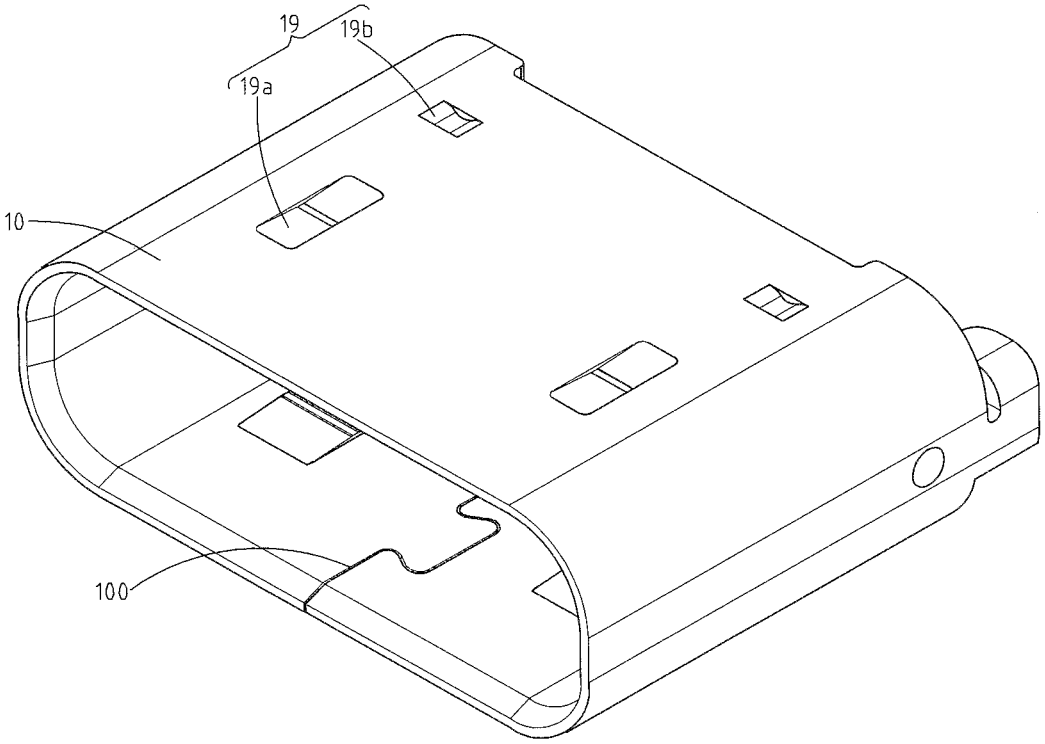
FIG. 7 illustrates an enlarged view of the metallic shell of FIG. 1.

Please refer to FIGS. 1 to 4 and FIG. 7, illustrating an electrical receptacle connector of an exemplary embodiment of the instant disclosure. FIG. 1 illustrates a perspective view of an electrical receptacle connector according to an exemplary embodiment of the instant disclosure. FIG. 2 illustrates an exploded view of the electrical receptacle connector. FIG. 3 illustrates an exploded view of an insertion module of the electrical receptacle connector. FIG. 4 illustrates a front view of a metallic shell of the electrical receptacle connector. FIG. 7 illustrates an enlarged view of the metallic shell of FIG. 1. As shown in FIGS. 1 to 4 and FIG. 7, the electrical receptacle connector 1 comprises a metallic shell 10 and an insertion module 20 enclosed by the metallic shell 10. In this embodiment, the connector comprises one insertion module 20, but embodiments are not limited thereto. In some embodiments, the metallic shell 10 may enclose several insertion modules 20.

The metallic shell 10 comprises two first walls 11 and two second walls 13. In this embodiment, the first walls 11 may be upper and lower walls, and the second walls 13 may be left and right walls. The first walls 11 are opposite to each other. The second walls 13 are opposite to each other. Each of the second walls 13 is connected to the first walls 11. The first walls 11 and the second walls 13 form an insertion space 15. One end of the inserting space 15 is adapted to be corresponding to an insertion opening of an electrical plug connector. The metallic shell 10 further comprises a plurality of protrusions 17 extending toward the insertion space 15 from the first walls 11. The protrusions 17 are integrally formed on the first walls 11 seamlessly; that is, the first walls 11 are free from openings, and the second walls 13 are free from openings.

Moreover, the metallic shell 10 may comprise a plurality of recesses 19. The recesses 19 are on the first walls 11. In detail, the protrusions 17 are on one of two opposite surfaces of each of the first walls 11, and the recesses 19 are on the other surface of each of the first walls 11. Each of the protrusions 17 and the corresponding recess 19 may be on the same position but different surfaces of the first wall 11. On the other hand, the protrusions 17 and the recesses 19 may be formed respectively. In this embodiment, recesses 19 include two front recesses 19*a* and two rear recesses 19*b*. The front recesses 19*a* are much closer to the end of the inserting space 15 which is adapted to be corresponding to an insertion opening of an electrical plug connector than the rear recesses 19*b*. In addition, the metallic shell 10 may be a one-piece member or may be formed by soldering several sheets with each other. In this embodiment, the metallic shell 10 includes a connecting seam 100, but no opening which penetrates the first walls 11 is formed on the first walls 11. Furthermore, no opening which penetrates the first walls 11 is formed on the second walls 13.

The insertion module 20 comprises an insulated housing 30, a plurality of first receptacle terminals 40, a plurality of second receptacle terminals 50, and a grounding plate 60. The first receptacle terminals 40, the second receptacle terminals 50, and the grounding plate 60 are fixed in the insulated housing 30. The first receptacle terminals 40, the second receptacle terminals 50, and the grounding plate 60 may be fixed in the insulated housing 30 by assembling or by insert-molding techniques. Therefore, the first receptacle terminals 40, the second receptacle terminals 50, and the grounding plate 60 can be molded with the insulated housing 30 to be firmly positioned in the insulated housing 30. The grounding plate 60 is between the first receptacle terminals 40 and the second receptacle terminals 50 for shielding and suppressing the crosstalk between terminals.

The insulated housing 30 comprises a base portion 31 and a tongue portion 33 extending from one side of the base portion 31. Each of the first receptacle terminals 40 comprises a flat contact portion 41 and a tail portion 43. Each of the second receptacle terminals 50 comprises a flat contact portion 51 and a tail portion 53. The flat contact portions 41 are on an upper surface 331 of the tongue portion 33, and the flat contact portions 51 are on a lower surface 333 of the tongue portion 33. Each of the tail portions 43 is extending from the corresponding flat contact portion 41 and protruding from the base portion 31, and each of the tail portions 53 is extending from the corresponding flat contact portion 51 and protruding from the base portion 31. In addition, the grounding plate 60 is protruding from a lateral surface 335 of the tongue portion 33.

Furthermore, the insertion module 20 further comprises a first conductive sheet 71 and a second conductive sheet 73. The first conductive sheet 71 is on an upper portion of the insulated housing 30 to partially shield the first receptacle terminals 40, and the second conductive sheet 73 is on a lower portion of the insulated housing 30 to partially shield the second receptacle terminals 50.

Figure 5:
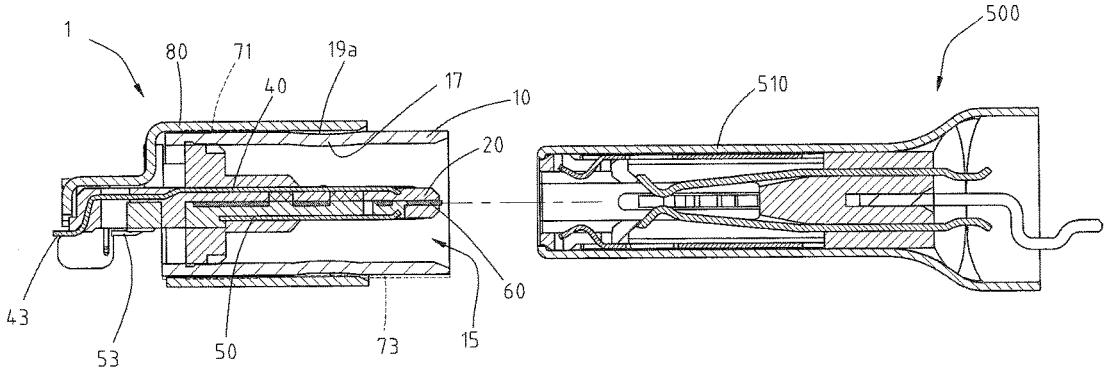
FIG. 5 illustrates a sectional view showing an assembly of an electrical plug connector and the electrical receptacle connector before being mated with each other.

Moreover, the electrical receptacle connector 1 further comprises a second metallic shell 80 assembled to the metallic shell 10 and enclosing the metallic shell 10 for providing a further shielding. Therefore, the first conductive sheet 71 is on the upper portion of the insulated housing 30 and disposed between the first metallic shell 10 and the second metallic shell 80. The second conductive sheet 73 is on the lower portion of the insulated housing 30 and disposed between the first metallic shell 10 and the second metallic shell 80. As shown in FIG. 2, the first conductive sheet 71 is an approximate strip shape, and the second conductive sheet 73 is an approximate cross shape. As shown in FIGS. 2 and 5, the first conductive sheet 71 covers the two rear recesses 19*b* on one of the first walls 11 after assembling the electrical receptacle connector 1. Moreover, the second conductive sheet 73 includes two wing portions 73*a* and a longitudinal axis portion 73*b*. The wing portions 73*a* are substantially parallel to the long-axis direction A1 of the first conductive sheet 71 and cover the two rear recesses 19*b* on the other first wall 11 after assembling the electrical receptacle connector 1. The longitudinal axis portion 73*b* is the other parts of the second conductive sheet 73 except the wing portions 73*a*. Furthermore, the longitudinal axis portion 73*b* covers the connecting seam 100. Accordingly, by the way of the disposition of the first conductive sheet 71 and the second conductive sheet 73 between the first metallic shell 10 and the second metallic shell 80, the waterproof effect of the overall electrical receptacle connector 1 is improved.

Figure 6:
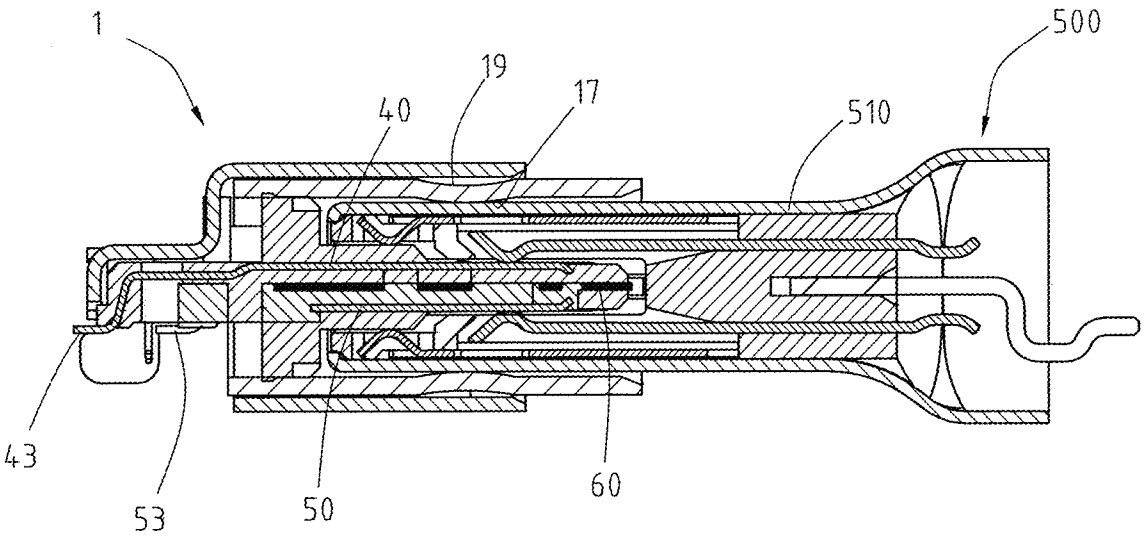
FIG. 6 illustrates a sectional view showing an assembly of the electrical plug connector and the electrical receptacle connector.

Please refer to FIGS. 5 and 6. FIG. 5 illustrates a sectional view showing an assembly of an electrical plug connector and the electrical receptacle connector before being mated with each other. FIG. 6 illustrates a sectional view showing an assembly of the electrical plug connector and the electrical receptacle connector. As shown in FIGS. 5 and 6, when the electrical receptacle connector 1 is mated with an electrical plug connector 500, the protrusions 17 are in contact with a metallic shell 510 of the electrical plug connector 500. Therefore, a grounding circuit is formed between the protrusions 17 and the metallic shell 510, and the electromagnetic interferences and the radiofrequency interferences can be greatly reduced. In addition, the protrusions 17 allow the electrical plug connector 500 to be mated with the electrical receptacle connector 1 closely and firmly so as to provide a waterproof function.

Moreover, the first receptacle terminals 40 and the second receptacle terminals 50 have a 180-degree symmetrical design with respect to a central point of the metallic shell 10 as the symmetrical center. That is, the pin-assignment of the first receptacle terminals 40 is left-right reversal with respect to that of the second receptacle terminals 50. Accordingly, the electrical receptacle connector 1 can have a 180 degree symmetrical, dual or double orientation design and pin assignments which enables the electrical receptacle connector 1 to be mated with a corresponding plug connector 500 in either of two intuitive orientations, i.e. in either upside-up or upside-down directions. Additionally, the protrusions 17 may be further provided as guiding members for guiding the electrical plug connector 500 to be mated with the electrical receptacle connector 1.

As above, the walls of the metallic shell are seamless. Therefore, after the electrical receptacle connector is mated with an electrical plug connector, the connector assembly of the plug and receptacle can be waterproof. Moreover, the protrusions of the metallic shell can be in contact with the metallic shell of the electrical plug connector, so that the electrical plug connector can be mated with the electrical receptacle connector firmly and closely to further improve the waterproof function, and the contacts between the protrusions and the metallic shell of the electrical plug connector can form a grounding circuit for reducing the electromagnetic as well as radiofrequency interferences during the operation. Accordingly, the connector can be utilized in high frequency, high transmission speed applications.

While the instant disclosure has been described by the way of example and in terms of the preferred embodiments, it is to be understood that the invention need not be limited to the disclosed embodiments. On the contrary, it is intended to cover various modifications and similar arrangements included within the spirit and scope of the appended claims, the scope of which should be accorded the broadest interpretation so as to encompass all such modifications and similar structures.

What is claimed is:

1. An electrical receptacle connector, comprising:

a first metallic shell comprising two first walls, two second walls, and a plurality of protrusions, wherein the first walls are opposite to each other, the second walls are opposite to each other, each of the second walls is connected to the first walls, the first walls and the second walls form an insertion space, the protrusions are extending toward the insertion space from each of the first walls, the protrusions are integrally formed on the first walls seamlessly and extending from an inside surface of each the first walls, and the first walls do not include an opening penetrating therethrough;

at least one insertion module enclosed by the first metallic shell, wherein the insertion module comprises an insulated housing, a plurality of first receptacle terminals, a plurality of second receptacle terminals, and a grounding plate, the first receptacle terminals, the second receptacle terminals, and the grounding plate are fixed in the insulated housing, and the grounding plate is between the first receptacle terminals and the second receptacle terminals;

a second metallic shell assembled to the first metallic shell and enclosing the first metallic shell; and a first sheet and a second sheet are disposed between the first metallic shell and the second metallic shell.

2. The electrical receptacle connector according to claim 1, wherein the first metallic shell comprises a plurality of recesses on the first walls, wherein the protrusions are on one of two opposite surfaces of each of the first walls, and the recesses are on the other surface of each of the first walls.

3. The electrical receptacle connector according to claim 1, wherein the first metallic shell is a one-piece member.

4. The electrical receptacle connector according to claim 1, wherein the insulated housing comprises a base portion and a tongue portion extending from one end of the base portion, each of the first receptacle terminals comprises a first flat contact portion, each of the second receptacle terminals comprises a second flat contact portion, the first flat contact portions and the second flat contact portions are respectively on an upper surface and a lower surface of the tongue portion.

5. The electrical receptacle connector according to claim 4, wherein the grounding plate is exposed from a lateral surface of the tongue portion.

6. The electrical receptacle connector according to claim 4, wherein each of the first receptacle terminals further comprises a first tail portion extending from the corresponding first flat contact portion, each of the second receptacle terminals further comprises a second tail portion extending from the corresponding second flat contact portion, the first tail portions and the second tail portions are protruding from the base portion.

7. The electrical receptacle connector according to claim 1, wherein the first receptacle terminals, the second receptacle terminals, and the grounding plate are fixed in the insulated housing by insert-molding techniques.

8. The electrical receptacle connector according to claim 1, wherein the first receptacle terminals, the second receptacle terminals, and the grounding plate are fixed in the insulated housing by assembling.

9. The electrical receptacle connector according to claim 1, wherein a pin-assignment of the first receptacle terminals is left-right reversal with respect to a pin-assignment of the second receptacle terminals.

10. The electrical receptacle connector according to claim 1, wherein the second walls do not include an opening penetrating therethrough.

11. The electrical receptacle connector according to claim 1 wherein the first metallic shell comprises a plurality of recesses on the first walls, wherein the protrusions are on one of two opposite surfaces of each of the first walls, and the recesses are on an outside surface of each of the first walls, and the first sheet and the second sheet cover parts of the recesses.

12. An electrical receptacle connector, comprising:

a first metallic shell comprising two first walls, two second walls, and two rear recesses on each of the first walls, wherein the first walls are opposite to each other, the second walls are opposite to each other, each of the second walls is connected to the first walls, the first walls and the second walls form an insertion space, and the first metallic shell comprises a connecting seam on one of the first walls;

at least one insertion module enclosed by the metallic shell, wherein the insertion module comprises an insulated housing, a plurality of first receptacle terminals, a plurality of second receptacle terminals, and a grounding plate, wherein the first receptacle terminals, the second receptacle terminals and the grounding plate are fixed in the insulated housing, and wherein the grounding plate is between the first receptacle terminals and the second receptacle terminals;

a second metallic shell assembled to the first metallic shell and enclosing the first metallic shell; and a first sheet and a second sheet disposed between the first metallic shell and the second metallic shell, wherein the first sheet and the second sheet are on a first and a second of the first walls, respectively, the first sheet the covers the two rear recesses on the first of the first walls, and the second sheet comprises a longitudinal axis portion and two wing portions, the longitudinal axis portion covers the connecting seam, and the wing portions are substantially parallel to a long-axis direction of the first sheet and covers the two rear recesses on the second of the first walls, the longitudinal axis portion of the second sheet and the wing portions form the entire of the sheet.

* * * * *